US009837049B2

(12) United States Patent
Matsukawa et al.

(10) Patent No.: US 9,837,049 B2
(45) Date of Patent: Dec. 5, 2017

(54) VISIBLE LIGHT COMMUNICATION SYSTEM

(71) Applicant: Panasonic Intellectual Property Management Co., Ltd., Osaka (JP)

(72) Inventors: Yoshihiko Matsukawa, Nara (JP); Masaaki Ikehara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 24 days.

(21) Appl. No.: 14/808,107

(22) Filed: Jul. 24, 2015

(65) Prior Publication Data

US 2016/0035318 A1 Feb. 4, 2016

(30) Foreign Application Priority Data

Jul. 30, 2014 (JP) ..... 2014-155588

(51) Int. Cl.
*G09G 5/12* (2006.01)
*G09G 5/00* (2006.01)

(52) U.S. Cl.
CPC ..... *G09G 5/12* (2013.01); *G09G 5/006* (2013.01); *G09G 2370/042* (2013.01); *G09G 2370/16* (2013.01); *G09G 2370/22* (2013.01)

(58) Field of Classification Search
CPC ..... G09G 2370/042; G09G 2370/16; G09G 2370/22; G09G 5/006; G09G 5/12
See application file for complete search history.

(56) References Cited

U.S. PATENT DOCUMENTS

2008/0253772 A1* 10/2008 Katsuyama ..... G08C 17/02 398/106
2011/0018754 A1 1/2011 Tojima et al.
2014/0093254 A1* 4/2014 Gotou ..... H04B 10/116 398/203

FOREIGN PATENT DOCUMENTS

JP 2006-155562 A 6/2006
JP 2006-261807 A 9/2006
JP 2008-263308 A 10/2008
JP 2009-124581 A 6/2009
JP 2009-206620 A 9/2009
JP 2009-260934 A 11/2009
(Continued)

*Primary Examiner* — Insa Sadio
(74) *Attorney, Agent, or Firm* — Renner Otto Boisselle & Sklar, LLP

(57) ABSTRACT

A visible light communication system includes: an illumination device which emits visible light including identification information; an information presentation apparatus which presents information to a person in a range illuminated by the visible light; an information terminal which receives visible light identification information; and an information recording medium which holds pairing information associating the identification information identifying the illumination device with connection information required for connection via wireless communication with the information presentation apparatus. When the information terminal is illuminated by the visible light, the information terminal refers to the pairing information held in the information recording medium to identify the connection information associated with the identification information included in the visible light, and establishes connection with the information presentation apparatus based on the identified connection information.

6 Claims, 11 Drawing Sheets

(56) References Cited

FOREIGN PATENT DOCUMENTS

| | | | |
|---|---|---|---|
| JP | 2012-083287 | A | 4/2012 |
| JP | 5178549 | B | 1/2013 |
| JP | 2013-171518 | A | 9/2013 |

* cited by examiner

VISIBLE LIGHT COMMUNICATION SYSTEM

CROSS REFERENCE TO RELATED APPLICATION

The present application is based on and claims priority of Japanese Patent Application No. 2014-155588 filed on Jul. 30, 2014. The entire disclosure of the above-identified application, including the specification, drawings and claims is incorporated herein by reference in its entirety.

BACKGROUND OF THE INVENTION

1. Field of the Invention

The present disclosure relates to visible light communication systems, and in particular, to a visible light communication system which allows pairing in wireless communication between an information terminal and an information presentation apparatus to be performed using visible light.

2. Description of the Related Art

A light communication (visible light communication) technique is currently available in which visible light emitted from an illumination device is modulated for data transmission and a receiver receives the visible light and decodes the data from the modulated visible light. Wireless communication requires a dedicated device. In contrast, visible light communication using illumination does not require a dedicated device because an illumination device, which is normally installed inside a building, serves two functions of illumination and communication. Accordingly, the visible light communication has advantages in that interior design can be given consideration, a range illuminated by visible light is visible, and communication can be established in a limited space or area. The visible light communication can be mainly used in, for example, location-based services provided inside buildings, where radio waves of the global positioning system (GPS) are unlikely to be provided, by causing each illumination device to emit location information as data.

In a space such as an office, a conference room, or a public facility, it may be desired that content in an information terminal held by a user is output to an information presentation apparatus (for example, a speaker, a television (TV), a projector, a printer, and an electronic whiteboard) located away from the user in the same space. In such a case, connection information of each information presentation apparatus in the wireless network, to which the information presentation apparatus is connected, is obtained, and the connection information (internet protocol (IP) address, service set identifier (SSID), and password in the case of wireless fidelity (Wi-Fi)) is input to the information terminal of the user for wireless network connection. Accordingly, pairing between the information terminal and the information presentation apparatus is performed in wireless communication, allowing the content in the information terminal to be transmitted to the information presentation apparatus for output or display. Additionally, the pairing allows the information terminal to remotely control the information apparatuses. In order to facilitate convenience, when communication is to be established between two apparatuses, the connection information of one of the apparatuses is desirably input to the other apparatus easily. The term "pairing" refers to a process in which apparatuses which communicate with each other in wireless communication register links to one another.

For example, Japanese Unexamined Patent Application Publication No. 2009-124581 (hereinafter, referred to as PTL 1) discloses a method of establishing a connection between apparatuses, by pairing a remote controller with a TV to be controlled by the remote controller.

According to the technique disclosed in PTL 1, in a wireless control apparatus including a TV and a remote controller which wirelessly controls the TV, the remote controller is turned on. The remote controller then outputs a connection request packet to the photodiode in the TV using an infrared light-emitting diode (LED) and simultaneously performs pairing in wireless communication. On the other hand, upon receipt of the light of the connection request packet, the TV performs pairing in wireless communication.

SUMMARY OF THE INVENTION

The conventional technique disclosed in PTL 1 is directed to pairing performed between specific apparatuses which are the remote controller and the TV. Hence, the infrared rays from the remote controller need to be directed to the photodiode in the TV. In other words, the operator is required to know the location of the TV. Moreover, the remote controller which has been paired with the TV is capable of controlling TV even from a relatively distant location (for example, from a room which is next to, above, or below the current room and separated by a wall from the current room). Hence, the remote controller is capable of changing channels even when another person is using the TV. Additionally, the TV (an apparatus to be controlled) needs to include a dedicated function (photodiode, demodulating unit and the like) for receiving a signal from the infrared LED of the remote controller. The conventional technique in PTL 1 is thus not applicable to an existing apparatus to be controlled.

The present disclosure has been conceived to solve such a conventional problem. An object of the present disclosure is to provide a visible light communication system which performs pairing between an information terminal and an information presentation apparatus. The pairing is performed while requiring the information presentation apparatus to include a wireless communication function instead of a dedicated function, and without requiring a dedicated operation for pairing in wireless communication.

In order to achieve the above object, a visible light communication system according to one aspect of the present disclosure includes: an illumination device which emits visible light including identification information identifying the illumination device, and performs communication using the visible light; an information presentation apparatus which presents information to a person in a range illuminated by the visible light; an information terminal which receives the identification information included in the visible light; and an information recording medium which holds pairing information associating the identification information identifying the illumination device with connection information required for connection via wireless communication with the information presentation apparatus, in which when the information terminal is illuminated by the visible light, the information terminal refers to the pairing information held in the information recording medium to identify the connection information associated with the identification information included in the visible light, and establishes connection with the information presentation apparatus based on the connection information identified.

The visible light communication system according to an aspect of the present disclosure performs pairing between an information terminal and an information presentation apparatus while requiring the information presentation apparatus to include a wireless communication function instead of a dedicated function, and without requiring a dedicated operation for pairing in wireless communication.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

The following describes embodiments in detail with reference to the drawings as appropriate.

It is to be noted that each of the embodiments described below shows a specific example of the present disclosure. The numerical values, structural elements, the arrangement and connection of the structural elements, steps, the processing order of the steps etc., shown in the following embodiments are mere examples and do not restrict the present disclosure. Furthermore, among the structural elements in the following embodiments, structural elements not recited in the independent claims each indicating the broadest concept are described as arbitrary structural elements.

(Embodiment 1)

Figure 1:
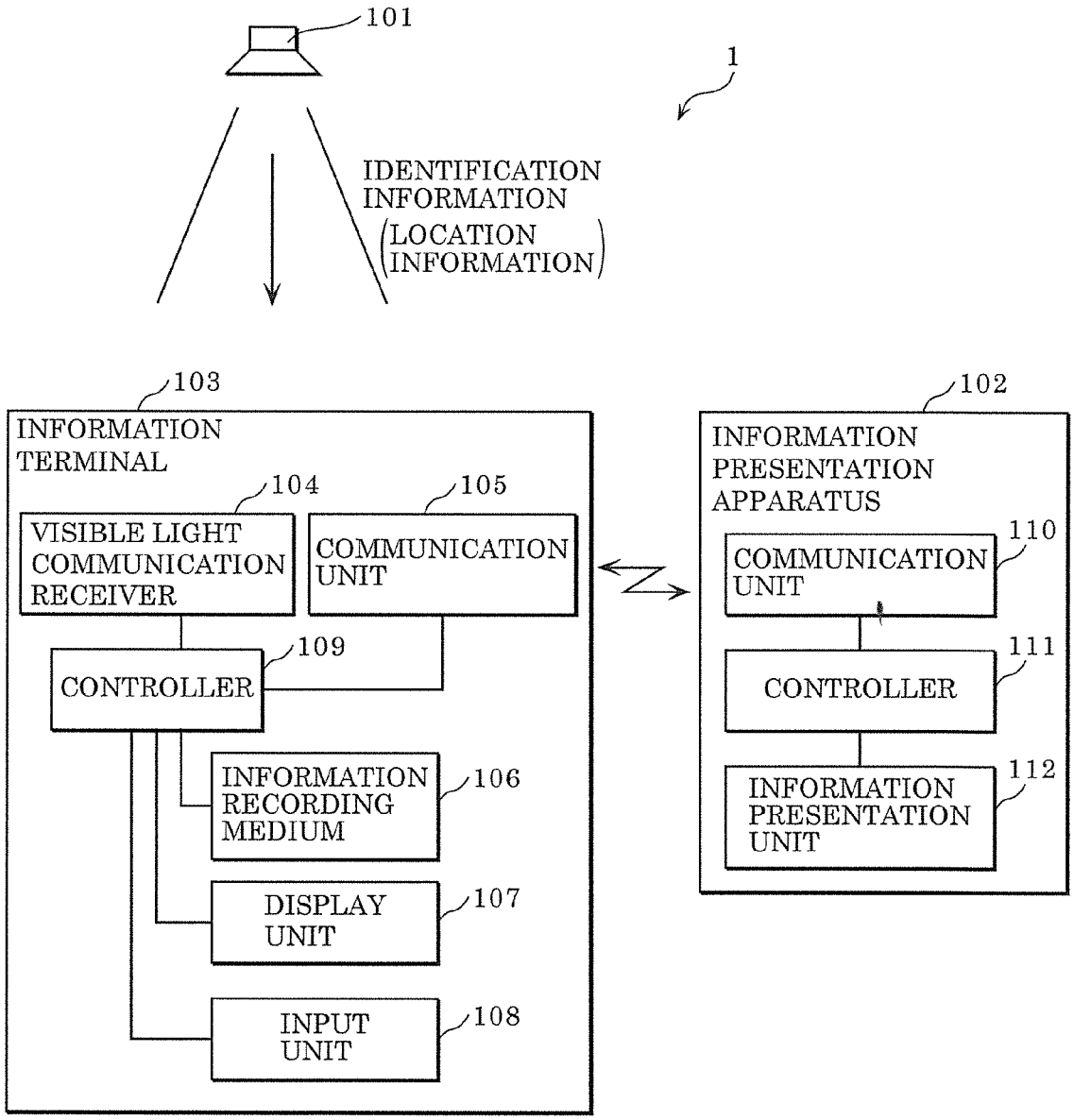
FIG. 1 illustrates a configuration of a visible light communication system according to Embodiment 1.

FIG. 1 illustrates a configuration of a visible light communication system according to Embodiment 1.

Visible light communication system 1 is a system in which pairing in wireless communication between information terminal 103 and information presentation apparatus 102 is automatically performed using visible light. Visible light communication system 1 includes illumination device 101, information presentation apparatus 102, and information terminal 103. Illumination device 101 performs communication using visible light. Illumination device 101 emits visible light including identification information identifying illumination device 101. Information presentation apparatus 102 presents information to a person or people in a range illuminated by the visible light emitted from illumination device 101. Information terminal 103 receives the identification information included in the visible light emitted from illumination device 101.

Illumination device 101 which emits visible light may be an illumination device which emits light of another wavelength such as infrared light, or a projector. Information presentation apparatus 102 is an apparatus which presents information, such as a speaker, a projector, a TV, a digital signage, an electronic whiteboard, a printer, and an illumination device. The information presented by information presentation apparatus 102 include not only video, image, audio, and text, but also light provided by the illumination device. This is to allow information terminal 103 to perform, for example, dimming or color adjustment on the illumination device. The expression "information presentation apparatus 102 presents information to a person or people in a range illuminated by the visible light" includes a meaning that information presentation apparatus 102 is located at a position where a person in the range illuminated by the visible light can directly view or hear information". For example, the expression includes a case where information presentation apparatus 102 is located in an area near the range illuminated by the visible light. Examples of the area near the range illuminated by the visible light include a room or a building in which illumination device 101 is located and which is surrounded by a door or a wall, an area divided by a partition, a private room in a restaurant, an area where each exhibit is present in a museum or an art museum.

Hereinafter, detailed configurations of illumination device 101, information presentation apparatus 102, and information terminal 103 will be described.

Illumination device 101 includes a light source (for example, LED), a power circuit which supplies power to the light source, and a visible light communication transmitter which modulates light and superimpose a signal on the modulated light (not illustrated). A signal (visible light communication signal, here, identification information) transmitted by illumination device 101 through visible light communication is, for example, a digital signal having a fixed length predetermined to illumination device 101. The visible light communication transmitter of illumination device 101 turns on the output of the power circuit (supplies power) or turns off the output of the power circuit (supplies no power) according to the value (1 or 0) of the digital signal so that the signal is superimposed on the illumination light. Examples of the digital signal include 128-bit ucode standardized by international telecommunication union (ITU). Illumination device 101 is generally fixed in a space, and thus, assignment of the ucode to illumination device 101 is convenience because the ucode is used as location information of each item. In the present embodiment, location information is used as an example of the identification information identifying illumination device 101. The identification information identifying illumination device 101 is also referred to as location information in the following description.

Information terminal 103 is capable of performing communication using visible light. Information terminal 103 includes visible light communication receiver 104, communication unit 105, information recording medium 106, display unit 107, input unit 108, and controller 109. Visible light communication receiver 104 is a circuit which receives and decodes the signal of visible light communication transmitted from illumination device 101. Communication unit 105 is a communication interface for communicating with information presentation apparatus 102. Information recording medium 106 holds pairing information associating the identification information identifying illumination device 101 (location information in Embodiment 1) with connection information required for connection via wireless communication with information presentation apparatus 102. In Embodiment 1, information recording medium 106 holds content to be reproduced by information presentation apparatus 102, application programs and the like, in addition to the pairing information required for the network connection with information presentation apparatus 102. Display unit 107 displays an operation graphical user interface (GUI). Input unit 108 is an input device for operation. Controller 109 is a circuit for controlling operations of information terminal 103, and, for example, includes a nonvolatile memory storing programs, a volatile working memory, a timer counter, and a processor which executes programs. Examples of information terminal 103 include a smart phone, a tablet, and a notebook computer. However, information terminal 103 is not limited to the above examples, but may be a dedicated terminal.

Information presentation apparatus 102 presents information using video, images, printed materials, sound, light, and the like (or provides light), and includes communication unit 110, controller 111, and information presentation unit 112. Communication unit 110 is a communication interface for communicating with communication unit 105 of information terminal 103. Information presentation unit 112 is an output unit which outputs the content transmitted from information terminal 103 and the like. Controller 111 is a circuit for controlling operations of information presentation apparatus 102, and includes, for example, a nonvolatile memory storing programs, a volatile working memory, and a processor which executes programs. Examples of information presentation apparatus 102 include a speaker, a projector, a TV, a digital signage, an electronic whiteboard, a printer, an illumination device, and an information terminal such as a personal computer (PC) each of which includes a network function (wireless communication function).

Figure 2:
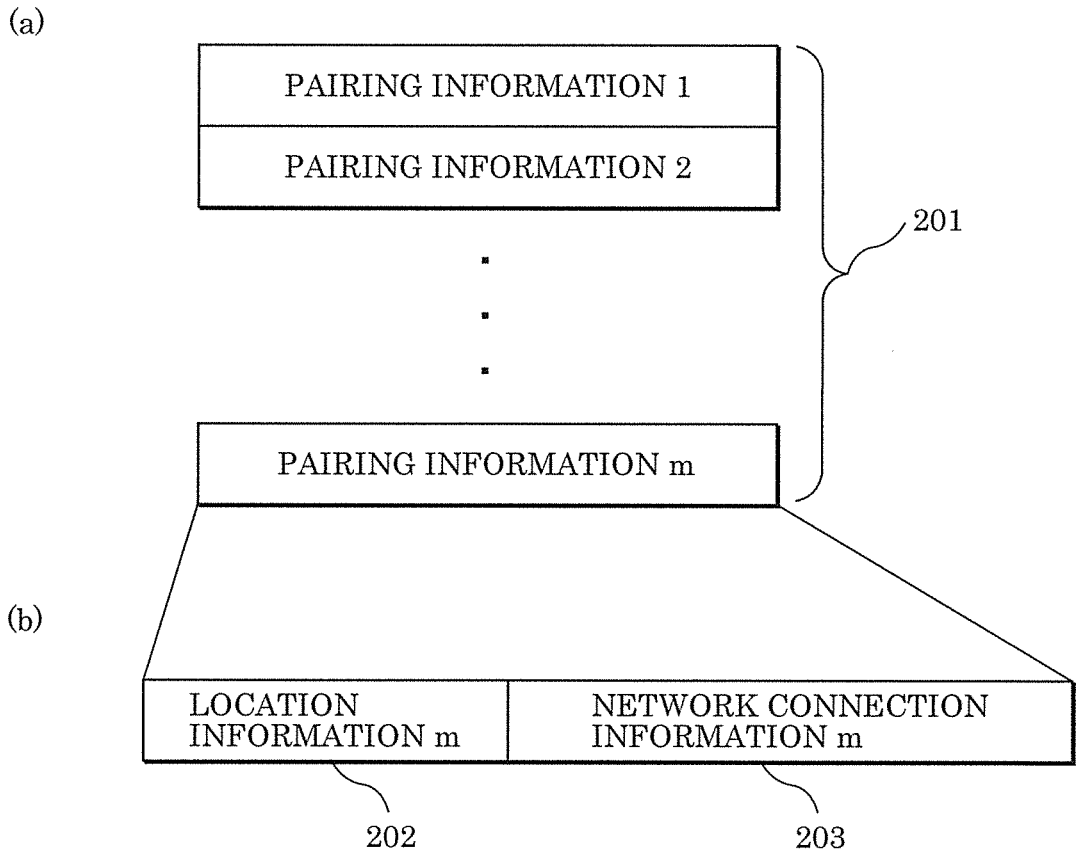
FIG. 2 illustrates a structure of pairing information according to Embodiment 1.

Referring to FIG. 2, pairing information held in information recording medium 106 will be described. Pairing information 201 is information which associates the identification information identifying illumination device 101 (location information in Embodiment 1) with connection information required for connection via wireless communication with information presentation apparatus 102. In Embodiment 1, pairing information is generated for each piece of location information (pairing information 1 to m in (a) of FIG. 2). Each piece of pairing information 201 includes location information 202 of corresponding illumination device 101, and network connection information 203 for connecting with information presentation apparatus 102 connectable near an area where a visible light communication signal from illumination device 101 can be received. Here, the term "network" refers to a communication network. Examples of the network include various networks such as Wi-Fi and Bluetooth (registered trademark). Network connection information 203 is connection information required for connection via wireless communication, and is, for example, an SSID, a security password, and an IP address in the case of Wi-Fi. Network connection information 203 is a model name (or a media access control (MAC) address), and a password of information presentation apparatus 102 in the case of Bluetooth (registered trademark). A plurality of information presentation apparatuses 102 which are connectable may be placed in the same space region (for example, in the same room). Such a case will be later described in Embodiment 3. In Embodiment 1, location information 202 and information presentation apparatus 102 are in a one-to-one correspondence (one information presentation apparatus 102 is associated with one piece of location information 202). An example of such a configuration is a case where a predetermined interpretive sound is output from a speaker (information presentation apparatus 102 which is connected via Bluetooth (registered trademark)) placed near an exhibit in a museum or an art museum.

Figure 3:
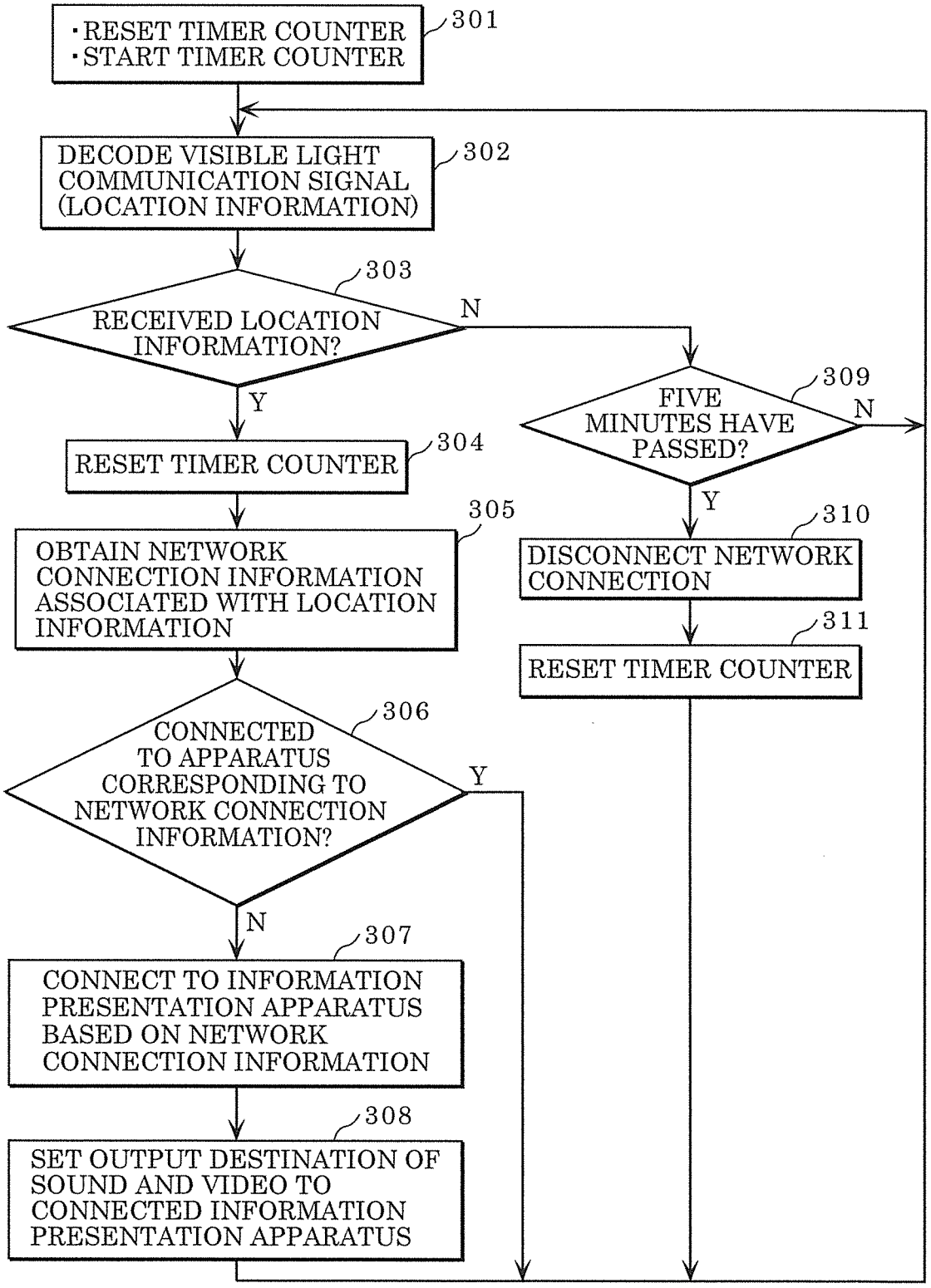
FIG. 3 is a flowchart of operations in the visible light communication system according to Embodiment 1.

Referring to the flowchart in FIG. 3, operations in visible light communication system 1 according to Embodiment 1 will be described. FIG. 3 illustrates a flow of operations of information terminal 103.

First, in Step S301, when information terminal 103 is started, controller 109 resets the internal timer counter and causes the timer counter to start counting up. In Step S302, visible light communication receiver 104 attempts to decode a visible light communication signal (location information) transmitted from illumination device 101. In Step S303, controller 109 determines whether or not visible light communication receiver 104 has successfully received location information 202. When location information 202 has been successfully received, controller 109 resets the timer counter to 0 in Step S304. In Step S305, controller 109 reads, based on received location information 202, network connection information 203 associated with received location information 202 from pairing information 201 in information recording medium 106. Subsequently, in Step S306, controller 109 determines whether or not connection with the apparatus indicated by read network connection information 203 (that is, information presentation apparatus 102) has been established. When the connection has been established, the processing returns to Step S302. When the connection has not been established, controller 109 establishes connection with information presentation apparatus 102 based on read network connection information 203 in Step S307. In Step S308, controller 109 sets the output destination of sound and video of information terminal 103 to information presentation apparatus 102 with which the connection has been established.

On the other hand, when the location information has not been received in Step S303, controller 109 determines in Step 309 whether or not the timer counter indicates a lapse of a predetermined time period (for example, five minutes). In Embodiment 1, the predetermined time period is five minutes, but the present disclosure is not limited to the example. The location information is not received successfully, for example, when information terminal 103 is out of the range illuminated by the visible light emitted from illumination device 101. Specific examples of the case where information terminal 103 is out of the range include a case where information terminal 103 is located in the shade of another object relative to the visible light emitted from illumination device 101, information terminal 103 is shielded by another object covering information terminal 103, or information terminal 103 leaves the range illuminated by visible light.

If five minutes have passed since the time counter was rest, controller 109 disconnects network connection from (cancels pairing with) information presentation apparatus 102 in Step 310, and resets the timer counter in Step 311. If five minutes have not passed since the time counter was reset, controller 109 returns to Step 302.

As described above, in the present embodiment, when information terminal 103 is illuminated by visible light, information terminal 103 refers to pairing information held in information recording medium 106 to identify connection information associated with the location information included in the visible light, and establishes connection with information presentation apparatus 102 based on the identified connection information. In other words, when information terminal 103 enters the range illuminated by illumination device 101 and receives location information, information terminal 103 is automatically connected to predetermined information presentation apparatus 102 placed near an area illuminated by visible light emitted by illumination device 101. Accordingly, pairing between information terminal 103 and information presentation apparatus 102 is performed while requiring information presentation apparatus 102 to include a wireless communication function instead of a dedicated function, and without requiring a dedicated operation for pairing in wireless communication. As a result, for example, information terminal 103 can output content to information presentation apparatus 102 placed near information terminal 103*c*, or information terminal 103 can operate information presentation apparatus 102.

When information terminal 103 leaves the range illuminated by visible light, information terminal 103 disconnects from information presentation apparatus 102. Accordingly, connection between information terminal 103 with information presentation apparatus 102 is established only when information terminal 103 is in the range illuminated by visible light. Hence, it is possible to prevent another information terminal located outside the range illuminated by the visible light from connecting with information presentation apparatus 102.

Here, when information terminal 103 is continuously out of the range illuminated by visible light for a predetermined period, information terminal 103 disconnects from information presentation apparatus 102. This prevents chattering phenomenon in which information terminal 103 and information presentation apparatus 102 are repeatedly connected and disconnected when information terminal 103 is near a border of the range illuminated by visible light.

In Embodiment 1, information terminal 103 includes display unit 107 and input unit 108, but these units are unnecessary if predetermined content is to be reproduced.

(Embodiment 2)

In Embodiment 1, pairing information is held in information recording medium 106 in information terminal 103, but the present disclosure is not limited to this example. The pairing information may be held in server 402 on the network.

Figure 4:
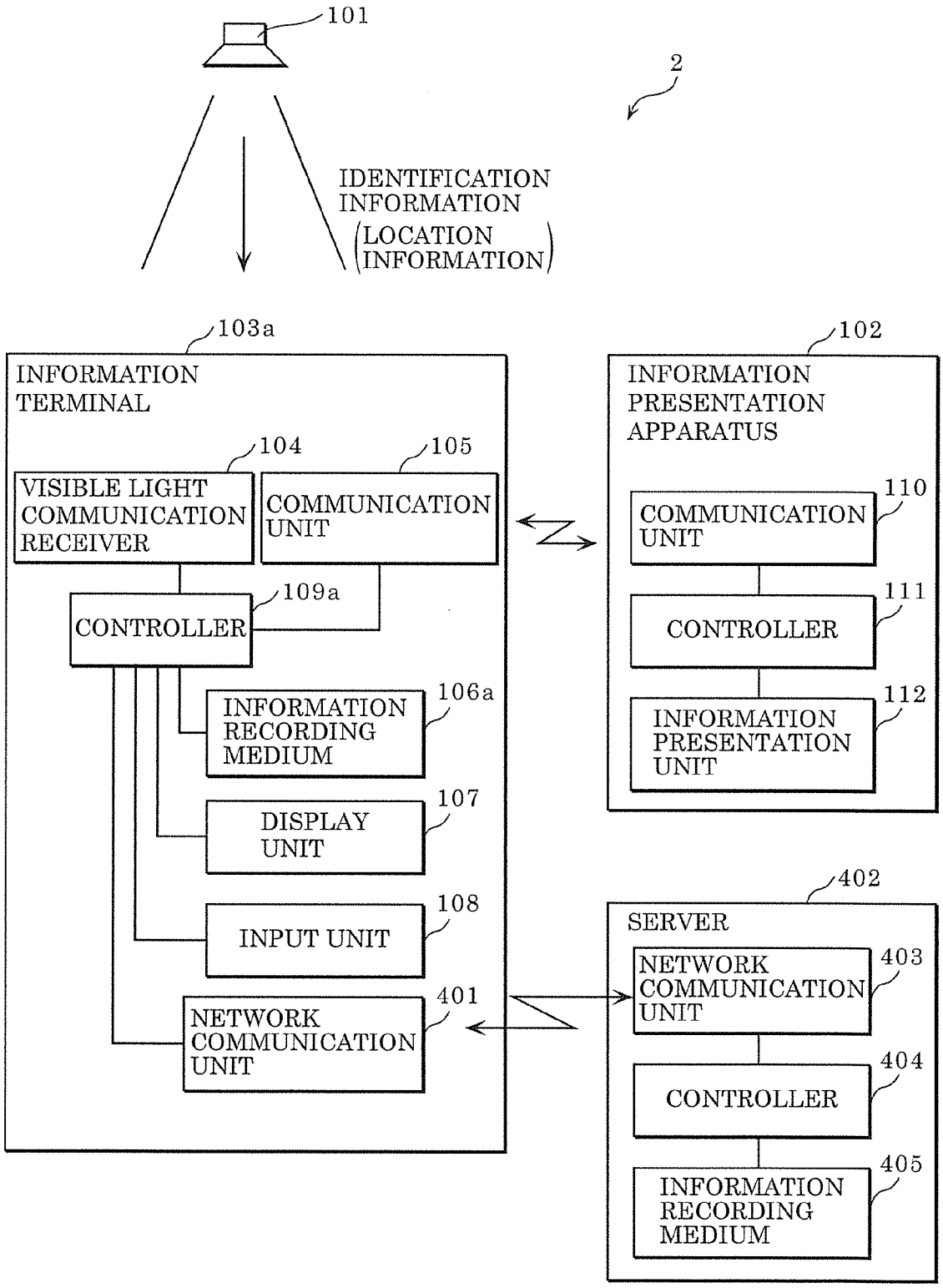
FIG. 4 illustrates a configuration of a visible light communication system according to Embodiment 2.

FIG. 4 illustrates a configuration of visible light communication system 2 according to Embodiment 2.

Visible light communication system 2 is a system in which pairing in wireless communication between information terminal 103*a* and information presentation apparatus 102 is automatically performed using visible light. Visible light communication system 2 includes illumination device 101, information presentation apparatus 102, information terminal 103*a*, and server 402. In Embodiment 2, illumination device 101 and information presentation apparatus 102 are approximately the same as those in Embodiment 1, and thus, the descriptions thereof are not given. The same reference numerals are assigned to the structural elements which are included in information terminal 103*a* and approximately the same as those in Embodiment 1, and the descriptions thereof are not given.

Information terminal 103*a* is capable of performing communication using visible light. Information terminal 103*a* includes visible light communication receiver 104, communication unit 105, information recording medium 106*a*, display unit 107, input unit 108, controller 109*a*, and network (NW) communication unit 401. NW communication unit 401 is a communication interface for communicating with server 402. In Embodiment 2, information recording medium 106*a* holds no pairing information, but holds content to be reproduced by information presentation apparatus 102, applications, and the like. Controller 109*a* is a circuit for controlling operations of information terminal 103*a*, and, for example, includes a nonvolatile memory storing programs, a volatile working memory, a timer counter, and a processor which executes programs.

Server 402 is an apparatus which provides pairing information to information terminal 103*a*, and includes NW communication unit 403, controller 404, and information recording medium 405. Information recording medium 405 is a recording medium which holds pairing information associating identification information identifying illumination device 101 (location information in Embodiment 2) with connection information of information presentation apparatus 102. In other words, information recording medium 405 holds pairing information required for network connection (wireless connection) of information presentation apparatus 102. NW communication unit 403 is a communication interface for communicating with information terminal 103*a*. Controller 404 is a circuit for controlling operations of server 402, and includes, for example, a nonvolatile memory storing programs, a volatile working memory, and a processor which executes programs. Server 402 may be, for example, a PC, and may be placed distant from information terminal 103*a* and information presentation apparatus 102 as long as server 402 is connected to the network.

NW communication unit 401 of information terminal 103*a* and NW communication unit 403 of Server 402 are communication interfaces which can use public mobile phone network, internet network via Wi-Fi, and the like. When network connecting information terminal 103*a* and information presentation apparatus 102 is the same type of network as network connecting information terminal 103*a* and server 402 (for example, Wi-Fi), the following is possible. Specifically, information terminal 103*a* can share communication unit 105 and NW communication unit 401, which eliminates the need for one of communication unit 105 and NW communication unit 401 (for example, NW communication unit 401 is unnecessary).

Figure 5:
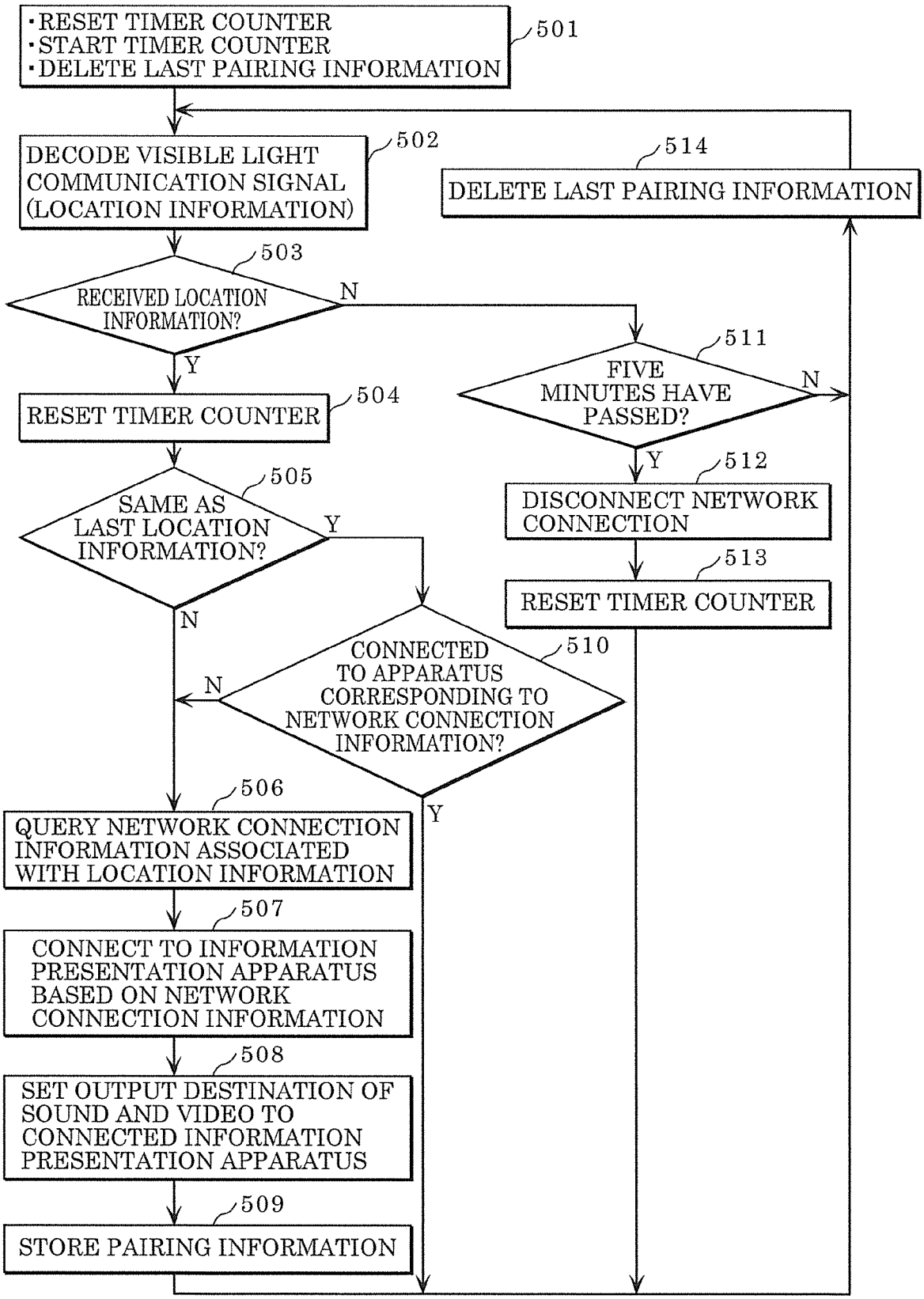
FIG. 5 is a flowchart of operations in the visible light communication system according to Embodiment 2.

Referring to the flowchart in FIG. 5, operations in visible light communication system 2 according to Embodiment 2 will be described. FIG. 5 illustrates a flow of operations of information terminal 103*a*.

First, in Step 501, when information terminal 103*a* is started, controller 109*a* resets the internal timer counter and causes the timer counter to start counting up, and deletes last pairing information. In Step 502, visible light communication receiver 104 attempts to decode a visible light communication signal (location information) transmitted from illumination device 101. In Step 503, controller 109*a* determines whether or not visible light communication receiver 104 has successfully received location information. When location information has been successfully received, controller 109*a* resets the timer counter to 0 in Step 504. In Step 505, controller 109*a* determines whether or not the currently received location information is the same as the last location information (held as the last pairing information). When the result of the determination indicates that the currently received location information is different from the last location information, controller 109*a* requests, in Step 506, server 402 to search information recording medium 405 for pairing information associated with the currently received location information. Specifically, controller 109*a* queries network connection information 203 associated with currently received location information 202, and, in Step 507, establishes connection with information presentation apparatus 102 based on network connection information 203 obtained as a result of the query. In Step 508, controller 109*a* sets the output destination of sound and video of information terminal 103*a* to information presentation apparatus 102 with which the connection has been established. In Step 509, controller 109*a* stores pairing information (the currently received location information and the network connection information of the information presentation apparatus with which the connection has been established) as last pairing information.

On the other hand, when the currently received location information is the same as the last location information in Step 505, controller 109*a* determines in Step 510 whether or not the connection with the apparatus of network connection information 203 (that is, information presentation apparatus 102) is still connected. When the connection is determined to be still connected, controller 109*a* returns to Step 502, and when the connection is determined not to be connected, controller 109*a* executes Step 506 to Step 509.

When the location information has not been successfully received in Step 503, controller 109*a* determines in Step 511 whether or not the timer counter indicates that a predetermined time period (for example, five minutes) has passed. When the timer counter indicates that five minutes have passed since the timer counter was reset, controller 109*a* disconnects network connection from (cancels pairing with) information presentation apparatus 102 in Step 512, and resets the timer counter in Step 513. When five minutes have not passed since the time counter was reset, controller 109*a* deletes the last pairing information in Step 514, and returns to Step 502.

With such operations, when information terminal 103*a* enters the range illuminated by illumination device 101 and receives location information as described above, information terminal 103*a* is automatically connected to predetermined information presentation apparatus 102 placed near an area illuminated by visible light emitted from illumination device 101. In other words, pairing between information terminal 103*a* with information presentation apparatus 102 is performed while requiring information presentation apparatus 102 to include a wireless communication function instead of a dedicated function, and without requiring a dedicated operation for pairing in wireless communication. As a result, for example, information terminal 103*a* can output content to information presentation apparatus 102 placed near information terminal 103*a*, or information terminal 103*a* can operate information presentation apparatus 102.

In Embodiment 2, the pairing information is held in server 402 instead of information terminal 103*a*. Hence, editing the pairing information in server 402 facilitates change to pairing between information terminal 103*a* and information presentation apparatus 102. As a result, the pairing information is centrally controlled, leading to increase in efficiency.

Moreover, in Embodiment 2, the latest pairing information is held in information terminal 103*a*. This avoids unnecessary query sent to server 402 on the network, leading to reduced communication traffic.

(Embodiment 3)

Embodiment 1 and Embodiment 2 describe the case where there is one information presentation apparatus 102, but in practice, a plurality of information presentation apparatuses may exist. In Embodiment 3, a user can select an information presentation apparatus to which an information terminal outputs information, from among a plurality of information presentation apparatuses.

Figure 6:
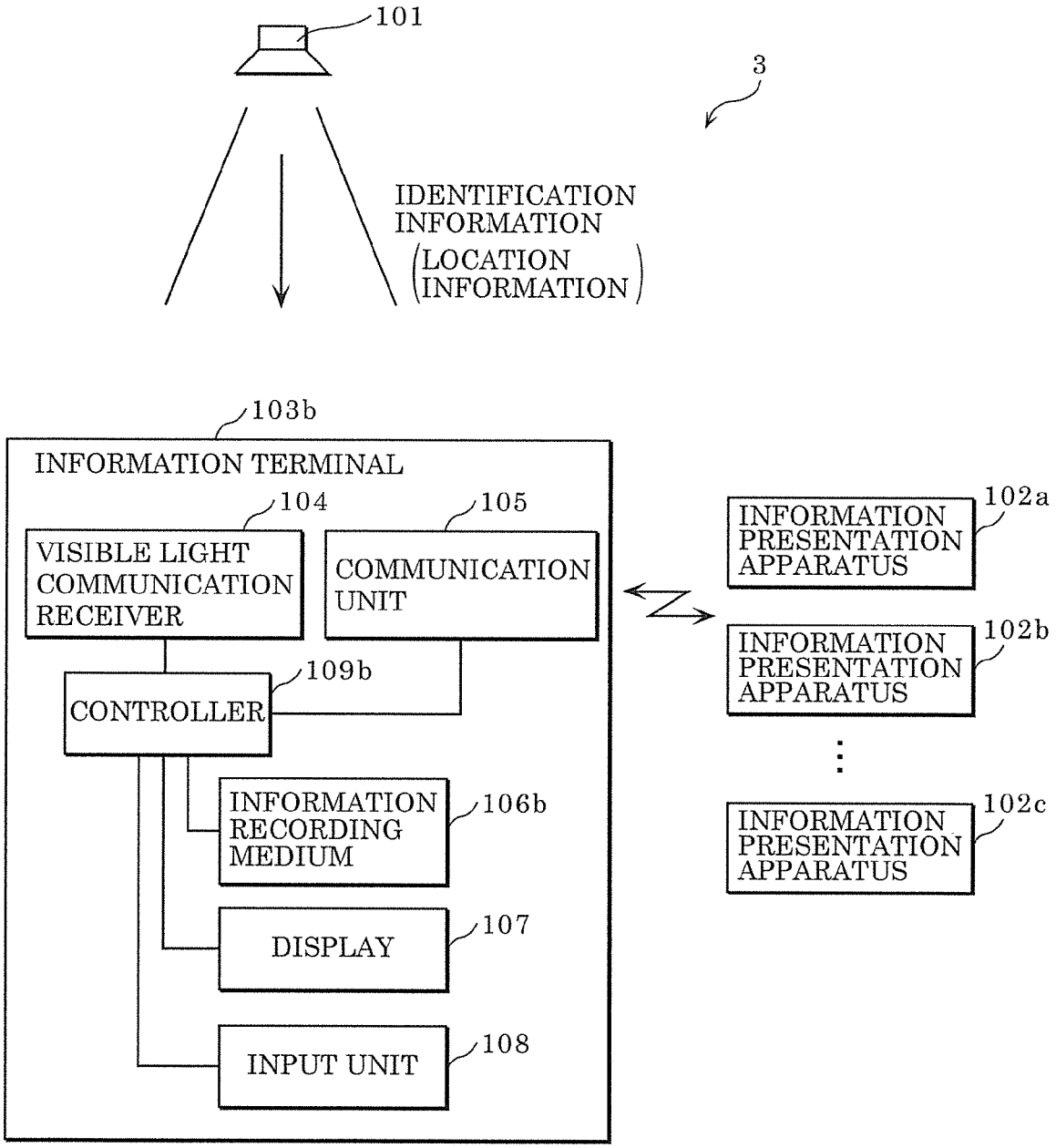
FIG. 6 illustrates a configuration of a visible light communication system according to Embodiment 3.

FIG. 6 illustrates a configuration of visible light communication system 3 according to Embodiment 3.

Visible light communication system 3 is a system in which pairing in wireless communication between information terminal 103*b* and information presentation apparatuses 102*a* to 102*c* is automatically performed using visible light. Visible light communication system 3 includes illumination device 101, information presentation apparatuses 102*a* to 102*c*, and information terminal 103*b*.

In Embodiment 3, illumination device 101 and information presentation apparatuses 102*a* to 102*c* respectively have approximately the same configurations as those of illumination device 101 and information presentation apparatus 102 according to Embodiment 1. Hence, the descriptions of illumination device 101 and information presentation apparatuses 102*a* to 102*c* according to Embodiment 3 are not given. The same reference numerals are assigned to the structural elements which are included in information terminal 103*b* and approximately the same as those in Embodiment 1, and the descriptions thereof are not given.

Information terminal 103*b* is capable of performing communication using visible light. Information terminal 103*b* includes visible light communication receiver 104, communication unit 105, information recording medium 106*b*, display unit 107, input unit 108, and controller 109*b*. Information recording medium 106*b* is a recording medium which holds pairing information associating the identification information identifying illumination device 101 and a plurality of pieces of connection information required for connection in wireless communication with information presentation apparatuses 102*a* to 102*c*. In Embodiment 3, information recording medium 106*b* holds pairing information associating the location information of one illumination device 101 with a plurality of pieces of connection information required for connection in wireless communication with information presentation apparatuses 102*a* to 102*c*. Controller 109*b* is a circuit for controlling operations of information terminal 103*b*, and, for example, includes a nonvolatile memory storing programs, a volatile working memory, a timer counter, and a processor which executes programs. It is assumed that information terminal 103*b* is a smart phone, and a processing program executed by controller 109*b* is given by an application downloaded from the internet or the like.

Information presentation apparatuses 102*a* to 102*c* associated with one illumination device 101 by pairing information are information presentation apparatuses belonging to one group, such as information presentation apparatuses of the same type or different types placed in the same room.

Figure 7:
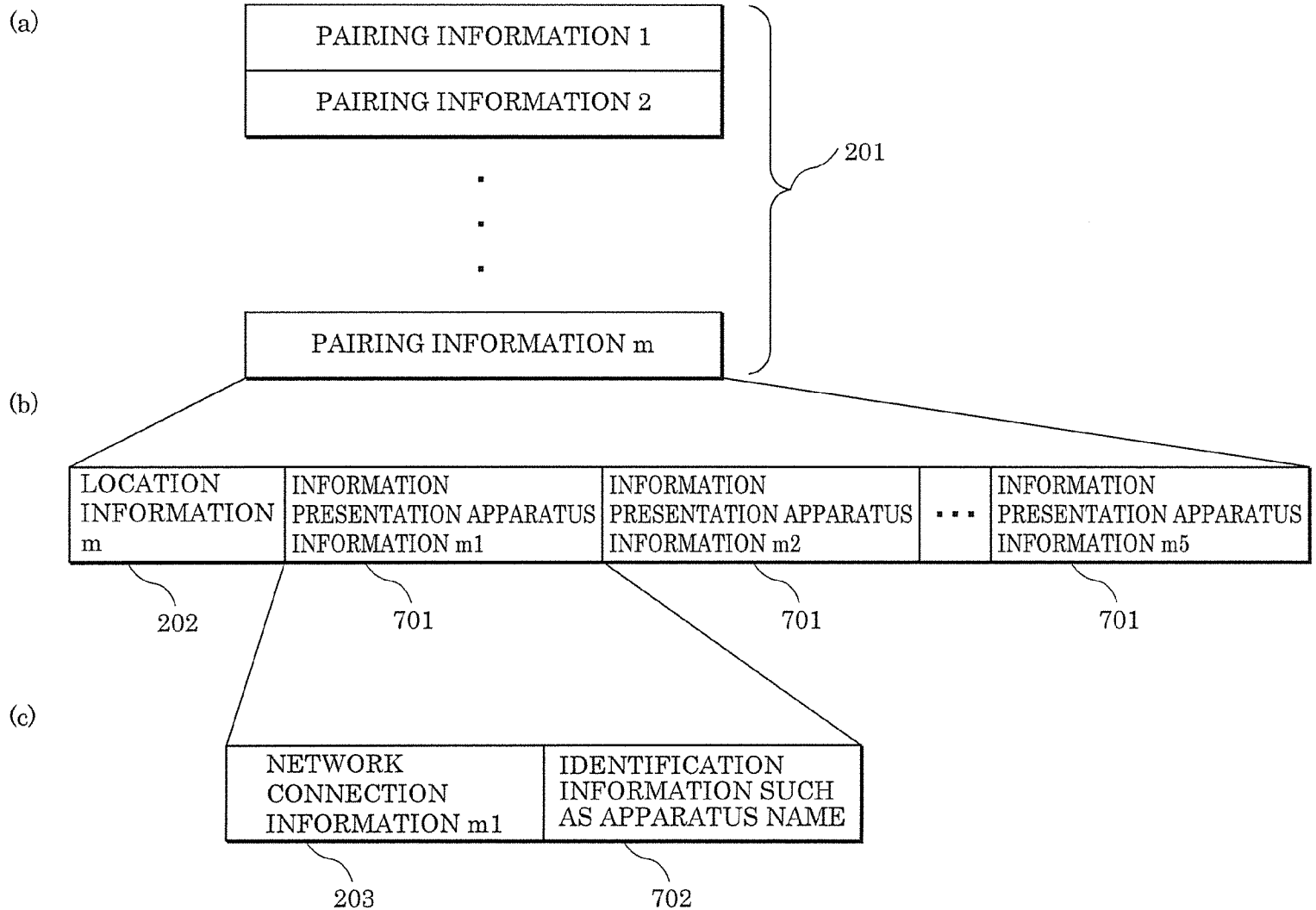
FIG. 7 illustrates a structure of pairing information according to Embodiment 3.

FIG. 7 illustrates a structure of the pairing information held in information recording medium 106*b*. Pairing information 201 is provided for each piece of location information transmitted from illumination device 101 (pairing information 1 to m in (a) of FIG. 7). Each piece of pairing information 201 includes corresponding location information 202 and a plurality of pieces of information presentation apparatus information 701 (location information m and information presentation apparatus information M1 to m5 in (b) of FIG. 7). Each piece of information presentation apparatus information 701 includes network connection information 203 and identification information 702 such as the name of an information presentation apparatus ((c) of FIG. 7). Information presentation apparatuses 102*a* to 102*c* each output certain details or types of content. For example, a speaker can output only sound information, and a TV, a projector and the like can output sound and video (moving pictures and still images).

An application is downloaded to information terminal 103*b* via a mobile telephone network or Wi-Fi, held in information recording medium 106*b*, and executed by controller 109*b*. Alternatively, the application may be constantly executed as a resident software, or activated by a user operation. Here, the application is assumed to be constantly executed as a resident software. Moreover, the application implements programs (software) corresponding to the processing in the flowcharts illustrated in FIG. 3, FIG. 5, and FIG. 8 and pairing information. For security purpose, the application is desirably operable only when location information is received from illumination device 101. Specifically, it is desirable that the application is operable under the location information which matches the location information included in the pairing information. Accordingly, the application is executable only under illumination device 101 which permits the operation of the application.

Figure 8:
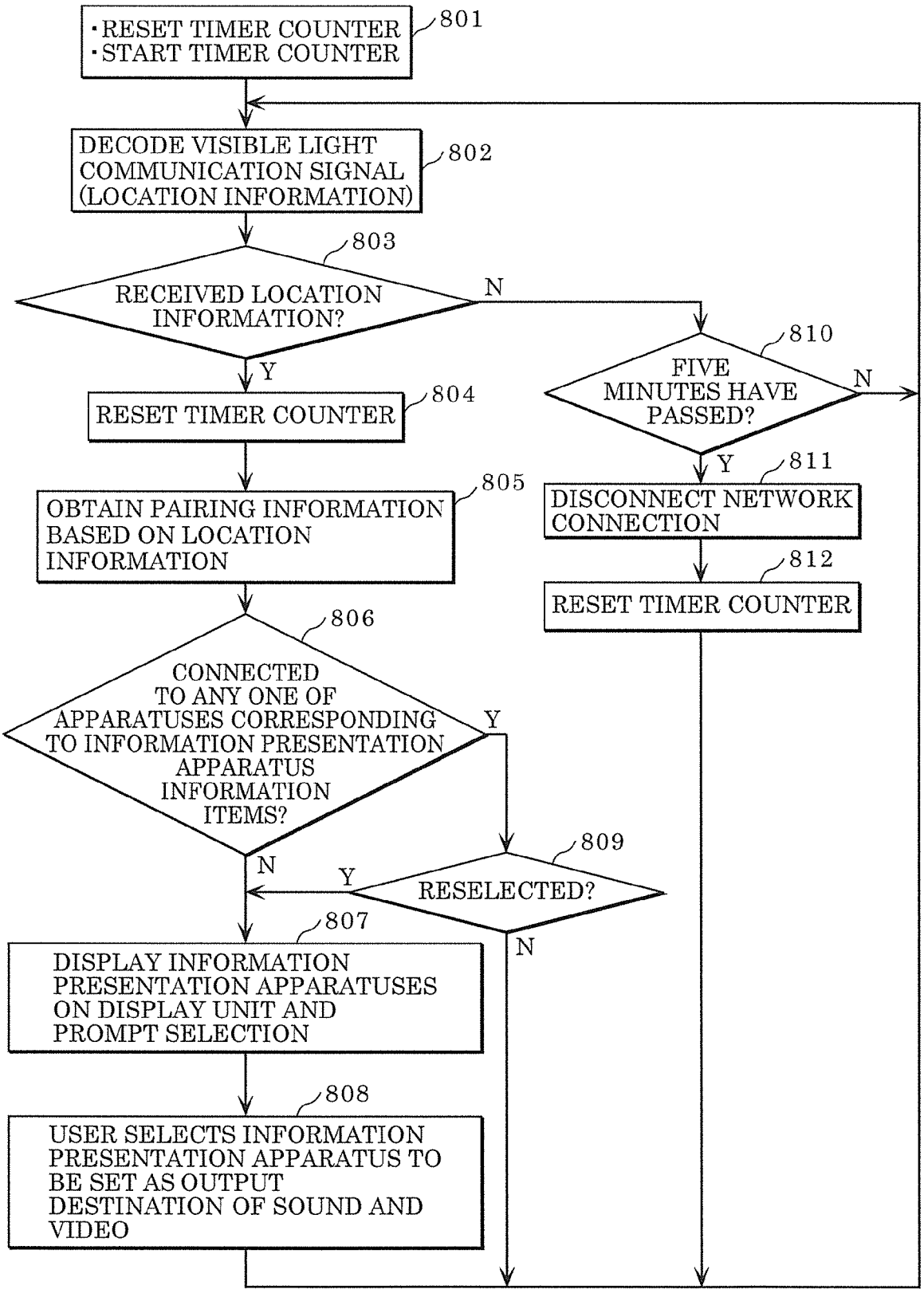
FIG. 8 is a flowchart of operations in the visible light communication system according to Embodiment 3.

A description will be given of operations in visible light communication system 3 according to Embodiment 3 in such a situation, with reference to the flowchart in FIG. 8. FIG. 8 illustrates a flow of operations of information terminal 103*b*.

Figure 9:
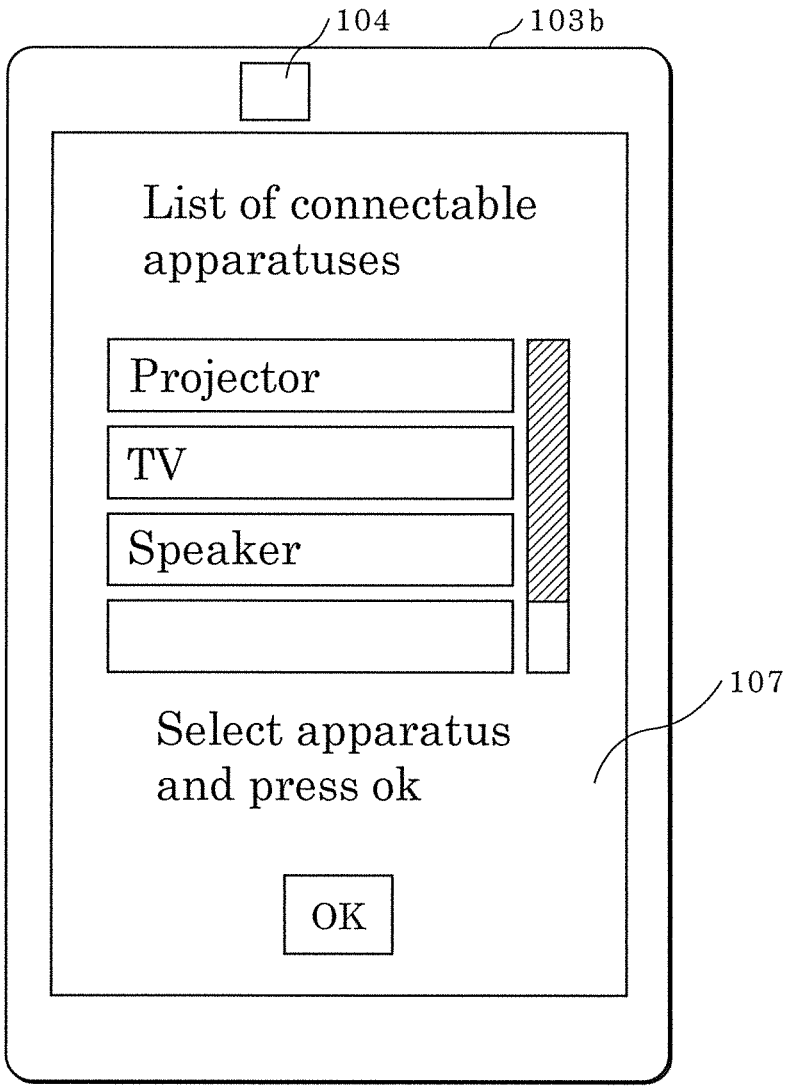
FIG. 9 illustrates an example of a screen display of an information terminal according to Embodiment 3.

First, after an application is started, controller 109*b* resets the timer counter and causes the timer counter to start counting up in Step 801. In Step 802, visible light communication receiver 104 attempts to decode a visible light communication signal (location information) transmitted from illumination device 101. In Step 803, controller 109*b* determines whether or not the location information has been successfully received. When the location information has been successfully received, controller 109*b* resets the timer counter to 0 in Step 804, and obtains pairing information based on the location information in Step 805. Controller 109*b* determines in Step 806 whether or not connection has been established with any one of information presentation apparatuses associated with the information presentation apparatus information included in the pairing information. When the result of the determination indicates that there is no established connection with information presentation apparatuses, in Step 807, controller 109*b* displays a list of information presentation apparatuses on display unit 107, as in the example of a screen display in FIG. 9, and prompts a user to select an information presentation apparatus to be connected. In Step 808, when the user selects at least one information presentation apparatus using input unit 108 (using a touch panel in the case of a smart phone), controller 109*b* makes a setting such that the smart phone outputs sound and video to the selected information presentation apparatus. Subsequently, the screen display in FIG. 9 is not shown on information terminal 103*b* (in the case of resident application, the application runs in the background), and another function (such as reproduction of content) can be executed.

On the other hand, when information presentation apparatus information includes information presentation apparatus information corresponding to the currently connected information presentation apparatus, controller 109*b* determines in Step 809 whether or not the user has performed reselecting operation of an information presentation apparatus (whether or not the user has reselected an information presentation apparatus). When the user has not performed the reselecting operation, controller 109*b* returns to Step 802, whereas, when the user has performed the reselecting operation, controller 109*b* executes Step 807 and Step 808.

On the other hand, when the location information has not bee successfully received in Step 803, controller 109*b* determines in Step 810 whether or not the timer counter indicates that a predetermined time period (for example, five minutes) has passed. When five minutes have passed since the timer counter was reset, controller 109*b* disconnects network connection from (cancels pairing with) the information presentation apparatus in Step 811, and resets the timer counter in Step 812. When five minutes have not passed since the timer counter was reset, controller 109*b* returns to Step 802.

In Embodiment 3, pairing information is encrypted and stored in an application so that the pairing information can be referred to only when the location information is received from illumination device 101. Such a configuration is also applicable to Embodiment 1. Security can be similarly secured in Embodiment 2 as well by encrypting access right to a server (an IP address, a login ID, a password and the like) for storage in an application.

As described above, in Embodiment 3, information recording medium 106*b* holds pairing information associating the location information of illumination device 101 with each of information presentation apparatuses 102*a* to 102*c*. When information terminal 103*b* is illuminated by visible light, information terminal 103*b* selects at least one piece of connection information from among a plurality of pieces of connection information associated with the location information included in the visible light, and establishes connection with at least one information presentation apparatus based on the selected at least one piece of connection information. In other words, even when a plurality of information presentation apparatuses 102*a* to 102*c* are present near an area illuminated by the visible light emitted from illumination device 101, the user is only necessary to select an information presentation apparatus to allow pairing between information terminal 103*b* and the selected information presentation apparatus. Hence, pairing is performed between information terminal 103*b* and a desired information presentation apparatus while requiring information presentation apparatuses to include a wireless communication function instead of a dedicated function, and requiring a user to simply select a desired information presentation apparatus from among a plurality of information presentation apparatuses. As a result, for example, information terminal 103*b* can output content to a desired information presentation apparatus, or information terminal 103*b* can operate the information presentation apparatus.

Moreover, in Embodiment 3, pairing information is encrypted and held in the form of an application on information terminal 103*b* (smart phone in Embodiment 3), and information terminal 103*b* receives permitted location information from illumination device 101. This prevents information from being output to an information presentation apparatus improperly (for example, from outside the room).

(Embodiment 4)

Figure 10:
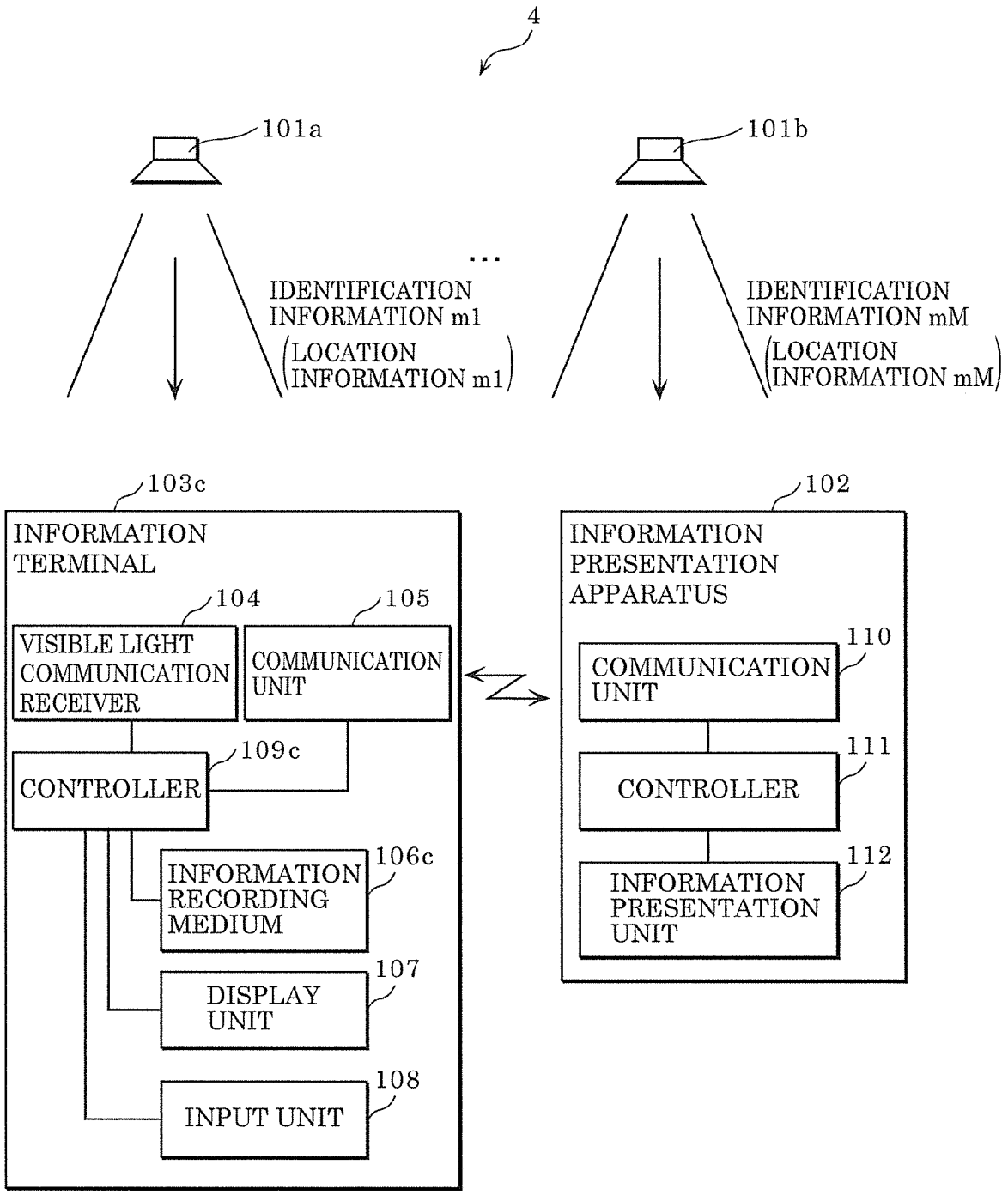
FIG. 10 illustrates a configuration of a visible light communication system according to Embodiment 4.

FIG. 10 illustrates a configuration of visible light communication system 4 according to Embodiment 4.

Visible light communication system 4 is a system in which pairing between information terminal 103*c* and information presentation apparatus 102 is automatically performed using visible light in wireless communication.

Visible light communication system 4 includes a plurality of illumination devices 101*a* to 101*b*, information presentation apparatus 102, and information terminal 103*c*.

In Embodiment 4, illumination devices 101*a* to 101*b* are approximately the same as illumination device 101 according to Embodiment 1 except that illumination devices 101*a* to 101*b* emit visible light including different pieces of identification information m1 to mM (location information m1 to mM in Embodiment 4). Information presentation apparatus 102 is approximately the same as that in Embodiment 1, and thus, its description is not given. The same reference numerals are assigned to the structural elements which are included in information terminal 103*c* and which are approximately the same as those in Embodiment 1, and the descriptions thereof are not given.

Information terminal 103*c* is capable of performing communication using visible light. Information terminal 103*c* includes visible light communication receiver 104, communication unit 105, information recording medium 106*c*, display unit 107, input unit 108, and controller 109*c*. Information recording medium 106*c* is a recording medium which holds pairing information associating a plurality of pieces of identification information identifying illumination devices 101*a* to 101*b* with connection information required for connection via wireless communication with information presentation apparatus 102. In Embodiment 4, information recording medium 106*c* holds pairing information associating the plurality of pieces of location information of illumination devices 101*a* to 101*b* with connection information required for connection via wireless communication with one information presentation apparatus 102. Controller 109*c* is a circuit for controlling operations of information terminal 103*c*, and, for example, includes a nonvolatile memory storing programs, a volatile working memory, a timer counter, and a processor which executes programs.

Illumination devices 101*a* to 101*b* associated with one information presentation apparatus 102 by pairing information are illumination devices belonging to one group, and are, for example, illumination devices installed in the same room.

Figure 11:
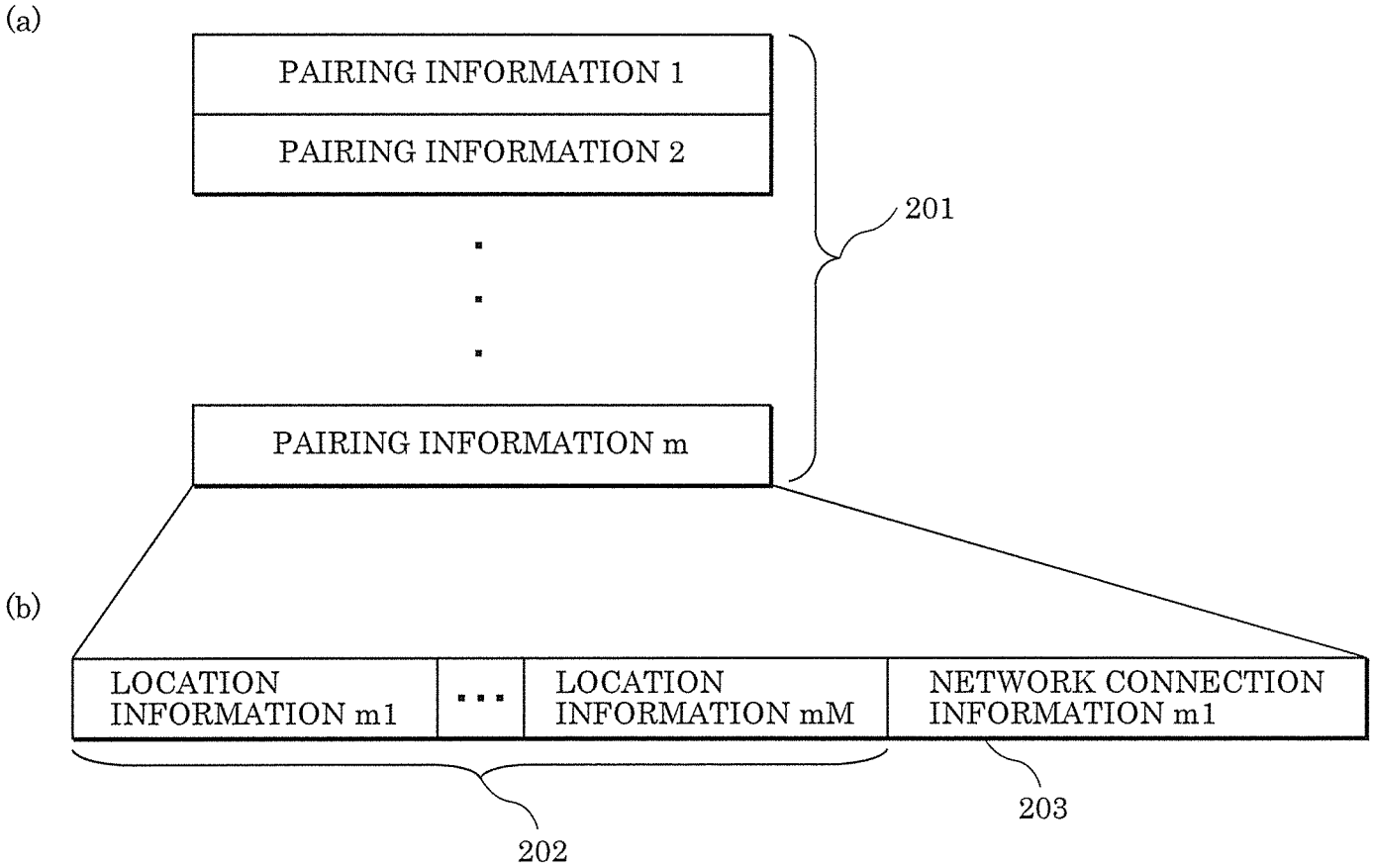
FIG. 11 illustrates a structure of pairing information according to Embodiment 4.

FIG. 11 illustrates a structure of pairing information held in information recording medium 106*c* of information terminal 103*c* according to Embodiment 4. As FIG. 11 illustrates, in Embodiment 4, pairing information 201 (pairing information 1 to m in (a) of FIG. 11) is generated for each piece of network connection information. Each piece of pairing information 201 includes a plurality of pieces of location information 202 and associated one piece of network connection information 203 (location information ml to mM and network connection information ml in (b) of FIG. 11).

Information terminal 103*c* operates in a similar manner to the flowchart in FIG. 3 according to Embodiment 1, but operates differently in Step 305. Specifically, controller 109*c* of information terminal 103*c* searches pairing information 201 based on the received location information. As a result of the search, if the received location information matches any one of the plurality of pieces of location information 202 in pairing information 201, controller 109*c* obtains associated network connection information 203, and establishes connection with information presentation apparatus 102 based on obtained network connection information 203. The other operations of Information terminal 103*c* are the same as those in the flowchart in FIG. 3.

As described above, in Embodiment 4, information recording medium 106*c* holds pairing information associating the plurality of pieces of location information of illumination devices 101*a* to 101*b* and connection information of information presentation apparatus 102. When information terminal 103*c* is illuminated by visible light emitted from at least one of illumination devices 101*a* to 101*b*, information terminal 103*c* refers to pairing information held in information recording medium 106*c* to identify connection information associated with the location information included in the visible light. Information terminal 103*c* establishes connection with information presentation apparatus 102 based on the identified connection information. In other words, when information terminal 103*c* enters the range illuminated by any one of illumination devices 101*a* to 101*b* and receives location information, information terminal 103*c* is automatically connected to predetermined information presentation apparatus 102 placed near an area where the visible light is emitted by the illumination device. Accordingly, pairing between information terminal 103*c* and information presentation apparatus 102 is performed while requiring information presentation apparatus 102 to include a wireless communication function instead of a dedicated function, and without requiring a dedicated operation for pairing in wireless communication. As a result, for example, information terminal 103*c* can output content to information presentation apparatus 102 placed near information terminal 103*c*, or information terminal 103*c* can operate information presentation apparatus 102.

Moreover, even when a plurality of illumination devices are present in the same room or area and each illumination device emits a different piece of location information (digits of location information may be partly or entirely different), pairing between information terminal 103*c* and information presentation apparatus 102 is automatically performed. In other words, information terminal 103*c* receives any one of a plurality of pieces of location information, and can connect to associated information presentation apparatus 102.

Visible light communication systems according to the present disclosure have been described based on Embodiments 1 to 4, but the present disclosure is not limited to Embodiments 1 to 4. Those skilled in the art would readily appreciate that, without departing from the teachings of the present disclosure, various modifications may be made in the above-described Embodiments 1 to 4 and other embodiments may be obtained by arbitrarily combining the structural elements in the above described Embodiments 1 to 4.

For example, pairing information held in an information recording medium may be a mixture of three types of pairing information described in Embodiments 1, 3, and 4. Specifically, the first type of pairing information may be pairing information which associates location information with connection information in a one-to-one correspondence as described in Embodiment 1. The second type of pairing information may be pairing information which associates location information with a plurality of pieces of connection information in a one-to-many correspondence as described in Embodiment 3. The third type of pairing information is pairing information which associates a plurality of pieces of location information with connection information in a many-to-one correspondence as described in Embodiment 4.

Moreover, in Embodiments 1 to 4, the information presentation apparatus is an apparatus which presents information (or provides light) on site, such as a speaker, a projector, a TV, a digital signage, an electronic whiteboard, a printer, and an illumination device, but the present disclosure is not limited to such apparatuses. The information presentation apparatus may be a reproduction apparatus which transmits content such as video and sound via wireless communication. With this, when pairing is performed between an information terminal and an information presentation apparatus, the content transmitted from the information presentation apparatus via wireless communication is reproduced by the information terminal.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A visible light communication system comprising:

an illumination device which emits visible light including identification information identifying the illumination device, and performs communication using the visible light;

an information presentation apparatus independent of the illumination device and which presents information to a person in a range illuminated by the visible light;

an information terminal which is a device independent of the illumination device and the information presentation apparatus, and which receives the visible light emitted by the illumination device including the identification information included in the visible light; and an information recording medium which holds pairing information associating the identification information identifying the illumination device with connection information required by the information terminal for connection via wireless communication with the information presentation apparatus, wherein when the information terminal is illuminated by the visible light, the information terminal refers to the pairing information held in the information recording medium to identify the connection information associated with the identification information included in the visible light, and establishes connection with the information presentation apparatus based on the connection information identified.

2. The visible light communication system according to claim 1, wherein the information terminal disconnects the connection from the information presentation apparatus when the information terminal is out of the range illuminated by the visible light.

3. The visible light communication system according to claim 2, wherein the information terminal disconnects the connection from the information presentation apparatus when the information terminal is continuously out of the range illuminated by the visible light for a predetermined period.

4. The visible light communication system according to claim 1, further comprising a server which performs communication with the information terminal, wherein the information recording medium is implemented in the server.

5. The visible light communication system according to claim 1, wherein the information presentation apparatus comprises a plurality of information presentation apparatuses, wherein the information recording medium holds pairing information associating the identification information with each of a plurality of pieces of the connection information of the plurality of information presentation apparatuses, and when the information terminal is illuminated by the visible light, the information terminal selects at least one of the plurality of pieces of the connection information which is associated with the identification information included in the visible light, and establishes connection with at least one of the plurality of information presentation apparatuses based on the selected at least one of the plurality of pieces of the connection information.

6. The visible light communication system according to claim 1, wherein the illumination device comprises a plurality of illumination devices, the information presentation apparatus provides either one of video and sound to a person in a range illuminated by each of the plurality of illumination devices, the information recording medium holds pairing information associating each of a plurality of pieces of the identification information of the plurality of illumination devices with the connection information of the information presentation apparatus, and when the information terminal is illuminated by at least one of the plurality of illumination devices, the information terminal refers to the pairing information held in the information recording medium to identify the connection information associated with the identification information included in the visible light, and establishes connection with the information presentation apparatus based on the connection information identified.

* * * * *